US005449473A

United States Patent [19]

Bunczk et al.

[11] Patent Number: 5,449,473

[45] Date of Patent: Sep. 12, 1995

[54] LAVATORY CLEANSING AND SANITIZING BLOCKS CONTAINING A HALOGEN RELEASE BLEACH AND A POLYBUTENE STABILIZER

[75] Inventors: Charles J. Bunczk, Norristown; Peter A. Burke, Downington; William R. Camp, Reading; John L. Orehotsky, Gilbertsville, all of Pa.

[73] Assignee: Kiwi Brands Inc., Douglassville, Pa.

[21] Appl. No.: 290,186

[22] Filed: Aug. 15, 1994

Related U.S. Application Data

[60] Continuation-in-part of Ser. No. 4,262, Jan. 14, 1993, Pat. No. 5,336,427, which is a division of Ser. No. 725,538, Jul. 3, 1991, Pat. No. 5,205,955.

[51] Int. Cl.[6] ..... C11D 1/24; C11D 3/395; C11D 3/43; C11D 17/00

[52] U.S. Cl. ..... 252/104; 4/231; 239/34; 252/95; 252/102; 252/106; 252/153; 252/162; 252/171; 252/174; 252/547; 252/558; 252/559

[58] Field of Search ..... 252/95, 102, 104, 134, 252/174, 162, 171, 547, 153, 558, 559

[56] References Cited

U.S. PATENT DOCUMENTS 4,537,604 8/1985 Dawson ..... 51/298
4,624,713 11/1986 Morganson ..... 134/25.2
4,683,072 7/1987 Holdt ..... 252/102
4,810,407 3/1989 Sandvick ..... 252/90
4,911,858 3/1990 Bunczk ..... 252/106
5,013,473 5/1991 Norbury ..... 252/174.13
5,205,955 4/1993 Bunczk ..... 252/102
5,298,078 3/1994 Itoh ..... 134/9
5,336,427 9/1994 Bunczk ..... 252/104
5,376,301 12/1994 Fleuren ..... 252/174.15

*Primary Examiner*—Dennis Albrecht
*Attorney, Agent, or Firm*—John Lezdey

[57] ABSTRACT

In a solid lavatory cleansing block containing a surfactant, a germicide agent or an oxidizing agent and fillers, the improvement which comprises said cleansing block having a polybutene compound in an amount from about 0.1 to 8% by weight of the composition to stabilize the bleaching agent, said polybutene compound of the formula:

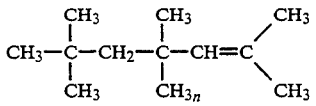

wherein n can be varied to give an average molecular weight of 320 to 2,300.

12 Claims, No Drawings

LAVATORY CLEANSING AND SANITIZING BLOCKS CONTAINING A HALOGEN RELEASE BLEACH AND A POLYBUTENE STABILIZER

RELATED APPLICATIONS

This application is a continuation-in-part of U.S. patent application Ser. No. 08/004,262, filed on Jan. 14, 1993, now U.S. Pat. No. 5,336,427 which in turn was a division of U.S. patent application Ser. No. 07/725,538, filed on Jul. 3, 1991 and issued as U.S. Pat. No. 5,205,955 on Apr. 27, 1993.

FIELD OF THE INVENTION

The present invention relates to solid cleansing and sanitizing blocks or tablets which are useful for the treatment of the flush water of toilets. More particularly, the invention is concerned with an improvement in connection with lavatory cleansing blocks or tablets containing germicides and/or oxidizing agents, especially chlorine release agents.

BACKGROUND OF THE INVENTION

In treating toilet flush water with chemicals so as to produce desirable effects such as bowl aesthetics, cleaning, disinfection, deodorization, etc., it is desirable that the chemicals be dispensed into the flush water automatically each time the toilet is flushed. The prior art discloses numerous solid lavatory cleansing blocks which have the capability of automatically dispensing metered amounts of chemicals to effect cleaning and sanitizing. However, prior to the present invention the oxidizing lavatory blocks or tablets had the disadvantage of a short shelf life and block life during use.

U.S. Pat. No. 4,780,236 to Bunczk, et al., issued Oct. 25, 1988, which is herein incorporated by reference, discloses a lavatory cleansing block containing polyethylene glycol distearate, guar gum, and sodium chloride. This patent, particularly in columns 3 through 5, identifies a variety of compositions and their concentrations for use in manufacturing a lavatory cleansing block or "toilet cake".

U.S. Pat. No. 3,504,384, Radlevy et al, which is herein incorporated by reference discloses a dual compartment dispenser for automatically dispensing a hypochlorite solution and a surfactant/dye solution to the toilet bowl during flushing. The dye which is taught in the patent is Disulfide Blue VN150. This dye is resistant to oxidation to a colorless state by hypochlorite; thus, it provides a persistent color to the toilet bowl water, even in the presence of the hypochlorite.

U.S. Pat. No. 4,269,723 to Barford, et al., which is herein incorporated by reference, discloses a process for making lavatory cleansing blocks by tabletting a free flowing particulate mix consisting essentially of, on a weight basis, from 5 to 90% of a surface active component and from 0.5 to 75% of one or more binders selected from clays and water soluble or water dispersible gel forming organic polymeric materials. Of the water soluble polymeric binders various optional components are also mentioned by Barford; namely, dyestuffs, perfume, water soluble fillers, water softening or chelating agents, solid water soluble acids, inert water insoluble inorganic or organic fillers, tablet lubricants, and agents having disinfecting or germicidal activity. Lubricants have been found to be ineffective to provide any effect of preventing degradation because of the presence of oxidizing agents.

U.S. Pat. No. 4,460,490 to Barford, et al., which is herein incorporated by reference discloses a freestanding lavatory cleansing block that comprises a shaped body formed of a slow dissolving cleansing composition containing a surface active agent and a tablet comprising a bleaching agent embedded in or adhered to the shaped body. The shaped body, according to the '490 patent, may be melt cast, tabletted, or extruded, depending upon the geometry of the shaped body. The shaped body preferably comprises the aforesaid surface active agent and a solubility control agent, for example, a water soluble or water dispersible gel forming polymer, for example, chemically modified celluloses.

U.S. Pat. No. 4,043,931 to Jeffrey, et al., which is herein incorporated by reference, discloses a lavatory cleansing block comprising a solid carrier base which is a mixture of two or more nonionic surface active agents, one of which is relatively insoluble in water and the other of which is relatively soluble in water. Suitable relatively water insoluble nonionic surface active agents are the mono and dialkanolamides of long chain fatty acids and polyalkoxylated fatty alcohols containing up to 6 moles of alkoxide. Suitable relatively water soluble surface active agents include polyalkoxylated fatty alcohols of more than 6 alkyleneoxy units per molecule and the alkyleneoxy block copolymers. The lavatory block of Jeffrey may optionally include perfume, dyestuff, germicide, and fillers, the latter being for example, a water softener such as a alkali metal polyphosphate. The blocks of Jeffrey are made by tabletting.

U.S. Pat. No. 4,229,410 to Kosti, which is herein incorporated by reference, discloses a bacteriostatic toilet element comprising a water sensitive, water soluble or swellable binding agent and a bacteriostatic and/or deodorizing and/or coloring agent. Kosti's element may be melt cast or extruded.

U.S. Pat. No. 4,119,578 to Daeninck, et al., discloses a hydrosoluble bar obtained by extrusion, the bar containing paraffin sulfonate as an extrusion aid.

SUMMARY OF THE INVENTION

It is an object of the present invention to provide an improved process for the manufacture of surfactant cleansing blocks comprising a surface active agent and a stabilizing agent.

It is a further object to provide surfactant cleansing blocks made in accordance with the process.

It is a primary object of the present invention to provide a surfactant cleansing block characterized by good integrity in aqueous media, thereby achieving a gradual release of the surface active agent and an oxidizing agent over an extended period of time.

Yet another object of the present invention is to provide an extrudable mass or a compressed tablet that lends itself to processing at extruder operating conditions that are designed to optimize the cleansing blocks' aforesaid characteristic good integrity.

The present invention broadly concerns a means for stabilizing a lavatory block or tablet against degradation by a reactive component such as oxidizing and/or sanitizing agent which is used in the forming of a tablet or block.

More particularly, the invention provides a stabilizer in the formed block or tablet which acts as a membrane barrier in the lavatory cleansing block or tablet. The block or tablet broadly comprises surfactants and oxidizing and/or germicidal agents.

The stabilizers which are used in the present invention are selected from the group consisting of mineral oil, silicone fluids and polybutenes. The stabilizers are present in an amount of about 0.1 to 8% by weight of composition. Higher amounts of the stabilizers can be used, however, the higher amounts results in a loss of block life when in use.

The preferred lavatory blocks of the invention are those containing a surfactant, a bleaching agent or halogen release agent and fillers containing the stabilizers of the invention. The preferred surfactants are the anionic surfactants which are relatively compatible with bleaching agents. The lavatory blocks of the invention are capable of being manufactured by conventional compressed tablet or extrusion processes.

DESCRIPTION OF THE PREFERRED EMBODIMENTS

In accordance with one embodiment of the invention there is provided an extruded lavatory cleansing block comprising about 20 to 40% by weight of an oxidizing or bleaching agent, about 0.1 to 8% by weight of a stabilizer selected from the group consisting of mineral oil, silicone fluids and polybutene, and about 50 to 65% by weight of an oxidation or halogen resistant anionic surfactant and optionally about 2 to 10% by weight of a solubility control agent and/or fillers.

A suitable extruded lavatory cleansing block having an improved shelf life of about 1–2 years and an in-bowl life from 30 days to 60 days can be prepared with a composition comprising about 20 to 40% by weight of a bleaching or halogen release agent, about 0.1 to 8% by weight of the stabilizer of the invention, about 50 to 65% by weight of an oxidation resistant anionic surfactant and about 2 to 10% by weight of a solubility control agent.

It is understood that the oxidizing or bleaching agents include halogen release agents. In addition, in lieu of oxidizing or bleaching agents there may be used germicidal agents, bactericidal agents, fungicides or any active agent commonly used in lavatory cleansing blocks. When other types of active agents are used it is not necessary to utilize oxidation resistant anionic surfactants. The surfactant may be any of the conventional anionic and/or nonionic surfactants.

Suitable anionic oxidation or halogen resistant anionic surfactants include alkyl dimethylamine oxides having 12 to 25 carbon atoms such as N,N-dimethyl-1-tetra-decanamine oxide and N,N-dimethyl-1-octadecanamine oxide, sodium lauroyl sarcosinate, diphenyl ether sulfonates such as the alkali metal salts of hexadecyl diphenyl ether disulfonic acid, dodecyl diphenyl ether disulfonic acid and decyl diphenyl ether disulfonic acid, preferably $C_{10}$–$C_{18}$ alkylbenzene sulfonates. Commercially available anionic surfactants which may be used include Ufaryl DL80, DL85 and DL90 of Unger Fabrikker which are mixtures of $C_{10}$–$C_{13}$ linear sodium alkylbenzene sulfonate, Udet 950 of De Soto, Nacconol 90G of Stepan Corporation (a $C_{11.7}$ linear alkybenzene sulfonate), Calsoft F90 of Pilot Corporation (a $C_{10}$–$C_{13}$ sodium linear alkylaryl sulfonate). Witconate 90F of Witco Corporation (a $C_{12}$ sodium alkylaryl sulfonate containing 1.7% free oil and 3.0% $SO_4$), Nansa HS 80PF of Albright & Wilson Ltd and Stepan agent X-1509-65 of Stepan Corporation (a $C_{13}$ calcium dodecylbenzene sulfonate).

The oxidizing and/or halogen release agents which can be used in connection with the present invention includes N-chlorinated cyanuric acid derivatives such as sodium dichloroisocyanurate, which is commercially available under the trademark "FICHLOR" or "CLZERON" and N-chlorosuccinimide, Chloramine T, dichlorosuccinimide, bromochlorodimethylhydantoin, 1,3-dichloro-5,5-dimethylhydantoin, alkali metal or alkaline earth metal hypochlorites such as chlorinated sodium tripolyphosphate Suitable germicides include for example formaldehyde release agents such as 1,3,5,7-tetra-aza-adamantane hexamethylenetetramine, chlorinated phenols, 1,3,5-tris(ethyl)hexahydro-striazine(VANCIDETH), 1,3-(dihydroxymethyl)-5,5-dimethylhydantoin (DANTOIN DMDMH-55), N-methylolchloroacetamide (GROTAN HD2), and the like.

Polybutenes are a series of viscous liquid polymers which are commercially available from Amoco chemical company and disclosed in Bulletin 12-M. The polybutenes that would have utility in the present invention are liquid copolymers of primarily isobutylene and some $\alpha$-butylene with a catalyst to give the following structure:

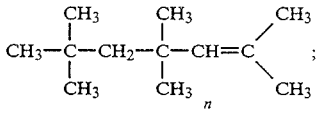

wherein n can be varied to give average weights of 320 to 2300. Of course, each of any product follows a nominal polymer distribution curve and molecular weights represent an average for that product.

For example, a polymer with an average molecular weight of 1340 will have a distribution majority of polymers in the 900 to 2000 range, and include lesser amounts from 200 up to the 9000 molecular weight segments.

Typical commercial products that can be used in our invention would include Polybutenes as manufactured by Amoco Chemical Company as their "L" or "H" series Polybutenes.

The silicone fluids which can be used are of the type commercially available from Dow Corning, for example, dimethyl siloxane, Dow Corning surfactant 190 and 193 which are silicone glycol copolymers having the chemical formula:

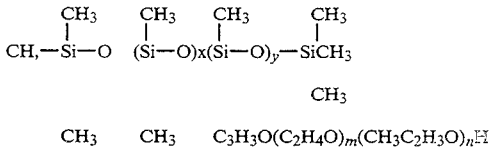

Dow Corning 1248 which is a secondary hydroxyl functional polydimethylsiloxane and Dow Corning Q2-1403 which is an ultra-high viscosity dimethiconol fluid in dimethicone composed primarily of polydimethylsiloxane. High molecular weight silicone gums provide greater in-bowl longevity to the block or tablet. Such gums are available from Dow Corning and listed in the Dow Corning Catalog entitled "Dow Corning Materials for High Technology Applications" (1986).

In its simplest form the tablet of the invention comprises an organic surface active agent, an active component such as the oxidizing or bleaching agent, germicide, bactericide, etc, a binder and the stabilizer of the invention.

The binder serves the purpose of controlling the rate of dissolution of the tablet and may comprise one or more ingredients.

The stabilizer in preparing the tablets by compression also function as a lubricating agent.

It has been found to be advantageous to utilize certain nonionic surfactants in the cake or tablet formulation. Nonionic surfactants that may be included are the condensation products of a long chain ethylene oxide moiety with an aliphatic alcohol preferably a primary or secondary aliphatic alcohol or alkyl phenol, preferably the primary or secondary alcohol contains 6 to 18 carbon atoms and the alkyl phenol-based moiety is one wherein the alkyl chain is straight or branched and contains 6 to 12 carbon atoms, preferably 6 to 9 carbon atoms.

Illustrative nonionic surfactants having the desired characteristics for formulation are available on the market under the tradename of "Neodol" products by Shell Oil Company; "Tergitol" products by Union Carbide Company; and "Alfol" products by Continental Oil Company. Specific examples include "Neodol 25-7" (linear $C_{12}$–$C_{15}$ primary alcohol condensed with 7 moles of ethylene oxide per mole of alcohol); "Neodol 45-7" (linear $C_{14}$–C15 primary alcohol mixture condensed with 7 moles of ethylene oxide per mole of alcohol); "Tergitol 15-S-7" (random secondary $C_{11}$–$C_{15}$ alcohol condensed with 7 moles of ethylene oxide per mole of alcohol); and "Alfol 1416-6.5" (primary $C_{14}$–$C_{16}$ alcohol condensed with 6.5 moles of ethylene oxide per mole of alcohol).

Such nonionic surfactants act as coupling agents to provide an integration of the cake components and may be used in the amount of about 0 to 30% by weight of the cake formulation.

Also useful to enhance the life of the cake are ethoxylated nonylphenols. A mixture of the high ethoxylated nonylphenol, that is, those having over 20 moles of ethylene oxide per mole of phenol, and low thoxylated nonylphenols provides slow dissolution of the cake formulation. Up to about 10% by weight of the ethoxylated nonylphenols is preferably utilized.

Water-soluble inert salts are used in the present compositions as "fillers" so that the composition can be formed into cakes of desired size without using excessive amounts of active ingredients. They are used alone or in combination in amounts up to about 64% by weight.

The inert salts (filler salts) used in compositions of the present invention can be any water-soluble inorganic or organic salt or mixtures of such salts. For purposes of the present invention, "water-soluble" means having a solubility in water of at least 0.2 grams per hundred grams of water at 20° C. Examples of suitable salts include various alkali metal and/or alkaline earth metal sulfates, chlorides, borates, bromides, citrates, acetates, lactates, etc.

Specific examples of suitable salts include calcium sulfate, sodium chloride, potassium sulfate, sodium carbonate, lithium chloride, tripotassium phosphate, sodium borate, potassium bromide, potassium fluoride, sodium bicarbonate, calcium chloride, magnesium chloride, sodium citrate, sodium acetate, calcium lactate, magnesium sulfate and sodium fluoride. The preferred salts are the inorganic salts, especially the alkali metal sulfates and chlorides. Particularly preferred salts, because of their low cost, are calcium sulfate and sodium chloride. The salts are present in compositions herein at levels of from about 20% to about 64% by weight (preferably from about 25% to about 35%). Most preferably, sodium chloride is utilized together with guar gum either alone or with other salts since the combination not only provides a synergistic viscosity increase of water and decreases the relative solubility properties of the matrix in water but also aids to prevent mounding.

A typical tablet of the present invention comprises:

(a) from 5 to 90% by weight of a surface active component comprising one or more organic surface active agents;
(b) from 0.5 to 75% by weight of one or more binders;
(c) from 0 to 20% of one or more dyestuffs, or other coloring agents;
(d) from 0 to 35% by weight of a perfume component,
(e) a total of from 0 to 75% by weight of
  (i) one or more inert water-soluble fillers;
  (ii) one or more water-softening or chelating agents;
  (iii) one or more solid water-soluble acids;
  (iv) one or more inert water-soluble inorganic or polymeric organic fillers (in an amount of not more than 50% by weight of the mixture);
  (v) about 0.1 to 1% of the stabilizers of the invention, and
(f) from 10 to 20% by weight of one or more germicides fungicides, and/or chlorine release agents.

Turning to specific classes of various optional ingredients which may be present in the compositions of the invention there may be first mentioned the compounds of reduced solubility as compared with the anionic surface active agents which may, indeed, be virtually wholly insoluble in water. Such agents should be resistant to attack by the halogen release component, both in the composition and in aqueous solutions produced by dissolution of the composition in use. It is a matter of simple experiment to determine whether any candidate is so resistant. Generally, the solubility control agent should be a saturated organic material. Examples of less soluble agents which may be employed include polyethylene waxes; low ethoxylates (e.g. containing up to 4 ethylene oxide units per mole) of fatty alcohols and alkylphenols; and paradichlorobenzene.

Certain of the less soluble agents noted above, the ethoxylate fatty alcohols and alkyl phenols, also possess surface active properties and thus may contribute to the overall cleansing effect of a composition containing them, In this connection it may be noted that other nonionic surfactants may be present in the compositions of the invention but that these should be present in lesser amounts than the anionic surface active agent component.

Other components which may be present in the compositions of the invention are inert fillers such as sodium sulphate and water softening agents such as sodium polyphosphates. These are suitably present, in total, in amounts of up to 50% by weight of the composition, generally amounts of from 5 to 30% by weight thereof. Commercially available anionic surface active agents often contain appreciable amounts of filler or diluent, such as sodium sulphate, and such commercially available materials may be used in formulating compositions in accordance with the invention to provide both the desired surface active component and some or all of the filler.

A further possible ingredient of a composition of the invention is a water-soluble salt of a polyvalent metal, especially a salt of calcium or magnesium. Lavatory cleansing compositions containing an artionic surfactant have different dissolution rates in hard and soft water, being more rapidly dissolved in soft water. This problem may be overcome by incorporating a water-soluble salt of a polyvalent metal in the composition, suitably in an amount of from 0.5 to 25% by weight, preferably from 5 to 15% by weight. The salt is preferably non-deliquescent and a particularly suitable salt is magnesium sulphate.

Dyes can be included at levels of from about 0 to 10.0 percent by weight. Examples of suitable dyes for use in non-oxidizing compositions are Alizarine Light Blue B (C.I. 63010), Carta Blue VP (C.I. 24401), Acid Green 2G (C.I. 42085), Astragon Green D (C.I. 42040), Supranol Cyanine 7B (C.I. 42675), Maxilon Blue 3RL (C.I. Basic Blue 80), acid yellow 23, acid violet 17, a direct violet dye (direct violet 51), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9. Others are disclosed in the aforementioned U.S. Pat. Nos. 4,310,434 and 4,477,363, which are herein incorporated by reference.

The cakes can also contain perfumes to impart an acceptable odor to the flushing water. The perfume can be in solid form and is suitably present in an amount up to 25 percent by weight. In this connection, it can be noted that the term "perfume" is intended to refer to any material giving an acceptable odor and thus materials giving a "disinfectant" odor such as essential oils, pine extracts, terpinolenes, ortho phenyl phenol or paradichlorobenzene can be employed. The essential oils and pine extracts also contribute as plasticizers and are functional to a degree in extending block life. Other suitable perfumes or fragrances are disclosed in U.S. Pat. No. 4,396,522 to Callicott, et al., which is herein incorporated by reference.

The cake formulation can also contain other binding and/or plasticizing ingredients serving to assist in the manufacture thereof, for example, polypropylene glycol having a molecular weight from about 300 to about 10,000 in an amount up to about 20 percent by weight and preferably about 4 percent to about 15 percent by weight of the mixture can be used.

The polypropylene glycol reduces the melt viscosity and acts as a molding release agent. Other suitable plasticizers such as pine oil fractions, d-limonene, dipentene, and ethylene oxide-propylene oxide block copolymers can be utilized.

In accordance with another embodiment of the invention the component ingredients of the tablet in particular form are formed into a particulate mixture and then tabletted to a tablet of the desired size, e.g. tablets having a weight of from 20 to 150 grams, preferably from 30 to 70 grams. The tablets should have an apparent density greater than that of water so that they will sink in the cistern and rest upon the bottom thereof and it has been found that the tablets generally have an apparent density in excess of 2 gms/cc, i.e. well above that of water.

It is generally preferred that the mixture to be tabletted consists only of dry particulate materials, i.e. does not contain any liquid but small amounts of liquid, e.g. up to 15% by weight of the total mixture, can be tolerated and thus the term powder mixture is intended to cover mixtures containing such small amounts of liquid.

The solid ingredients in the powder mixture are in particulate form and thus may be in the form of powders, granules (for example having a particular size of up to 1 mm) or flakes.

The pressure under which the powder mixture is compressed to form the tablets is of importance in that if the pressure is to low, the tablet has an insufficiently high strength and tends to dissolve too rapidly whereas if the pressure is too high the tablet tends to dissolve too slowly. The actual pressure employed for making a tablet out of any particular composition will depend, to some extent, upon the nature of the ingredients and their relative proportions in the mixture. In any event, it will be a matter of simple routine trial to establish the preferred measure for tabletting any particular particulate mixture.

The tablets produced in accordance with the invention may subsequently be provided with a coating of a water-soluble film, such as polyvinyl alcohol, to make handling thereof more convenient.

Processing aids such as volatile silicone compounds such as sold by Dow Corning under the trademark Dow 344 have been found to be useful when utilizing polybutene as the stabilizing agent.

The prepared tablet preferably has a matrix ph of about 5.5 to 10.0.

The composition used for preparing tablets by compression can be generally formulated for extrusion by the addition of about 10 to 25 percent by weight of extrusion aids, for example, anionic alkalyds such as sodium dodecylbenzene sulfonate, diphenyl ether sulfonates, and the like.

In the extrusion process, a homogeneous blend has a granular consistency obtainable at less shear than the blend. Accordingly, mixers such as the ribbon blender are preferably used. The blend is then fed to the barrel of a screw extruder, and passed through the extruder to form a continuous extrudate which is then cut to the size block desired. The pressure through the die is typically about 500–1250 psi. Unlike many conventional extrusion processes, the barrel of the extruder is maintained at less than about 122° F., preferably at less than about 95° F. Most preferably, the barrel is kept an ambient temperature by means of cooling water circulated through an external barrel jacket. The die head may be heated to between about 85° to about 176° F., preferably less than about 144° F., to assure a smooth surface of the product extrudate. The block in said continuous extrudate form begins to cure upon leaving the extruder, and hence is cut into cleansing blocks of requisite size by conventional cutting means as soon as practicable downstream of the die and before substantially complete curing. Ability to cut the continuous extrudate is enhanced by presence of an organic oil.

When an extrusion process is employed the mixture to be extruded should contain up to 25% by weight preferably from 1.0% to 15% by weight, of a liquid component or a solid component which is liquefied under extrusion conditions to act as a processing aid. In the case of the compositions of the invention this is conveniently provided by the use of a liquid less-soluble agent such as lower ethoxylated alcohol or alkyl phenol.

The principals, preferred embodiments, and modes of operation of the present invention have been described in the foregoing specification. The invention which is intended to be protected herein, however, is not to be construed as limited to particular forms disclosed, since these are to be regarded as illustrative rather than restrictive. Variations and changes can be made by those skilled in the art without departing from the spirit of the invention.

EXAMPLE 1

An extruded lavatory cleansing block was prepared with the following ingredients.

| Ingredient | % Wt |
|---|---|
| Sodium linear alkylbenzene sulfonate (Nansa HS80PS (50%) - Marlon A390-(50%) | 61.0 |
| Sodium dichloroisocyanurate | 30.0 |
| Neodol 91 (Lin. $C_9$–$C_{11}$ alcohol) | 8.0 |
| Purified mineral oil | 1.0 |
| | 100.0 |

In lieu of mineral oil there may be used an equal amount of Dow Corning 190.

EXAMPLE 2

An extruded lavatory cleansing block was prepared with the following ingredients:

| Ingredient | % Wt |
|---|---|
| Sodium dodecyl benzene sulfonate* | 52.0 |
| Chloramine T | 31.5 |
| Neodol 91 | 8.0 |
| Polybutene | 4.0 |
| Perfume | 0.5 |
| Volatile Silicone Oil | 4.0 |

*Sodium dodeyl benzene sulfonate used as Nansa HS 80S, a commercial product containing 80% by weight active sulfonate and balance mainly sodium sulfate.

In lieu of the silicone oil there may be utilized high molecular weight silicone gums or dimethicone fluids.

EXAMPLE 3

A cleansing block is formed with the following composition as follows.

TABLE 3

| Ingredient | % Wt |
|---|---|
| Calcium Sulfate Fine Dihydrate | 47.0 |
| Calcium Sulfate Fine Anhydrous | 25.8 |
| Fumed Silica | 5.0 |
| Cleanfront (liquid iodophor) | 8.5 |
| Povidone | 5.7 |
| Acid Blue #9 | 5.0 |
| Polyox Coagulant | 2.0 |
| Purified mineral oil | 1.0 |
| | 100.0 |

The resulting tablet of this example had an in-tank life of about 30 days and met the EPA dye and iodophor dissolution requirements until the end of the period or life of the toilet cake. If desired, in place of a portion of the calcium sulfate, there can be added fragrances and citric acid to this composition.

EXAMPLE 4

A cleansing tablet is prepared from the following composition:

TABLE 4

| Ingredient | Percent |
|---|---|
| Calcium Sulfate, dihydrate (fine) | 60.45 |

TABLE 4-continued

| Ingredient | Percent |
|---|---|
| Calcium Sulfate, anhydrous (fine) | 4.51 |
| Aerosol 380 | 3.97 |
| Cleanfront | 11.07 |
| PVP-I2 | 4.00 |
| Acid Blue #9 | 4.00 |
| Polyox, coagulant | 2.00 |
| Polyethylene Glycol E4500 | 3.00 |
| Sodium Dodecyl Benzene Sulfonate | 5.00 |
| Polybutene | 2.0 |
| | 100.00 |

The formula provides a cleansing block having good antibacterial properties and complies with the EPA dissolution requirements. In lieu of sodium dodecyl benzene sulfonate there can be utilized in its place a similar amount of sodium alpha olefin ($C_{14}$–$C_{16}$) sulfonate.

EXAMPLE 5

An extruded lavatory cleansing block was prepared with the following ingredients.

| Ingredient | % Wt |
|---|---|
| Sodium dodecylbenzene sulfate (Marlon A 390) | 62.0 |
| Sodium Dichloroisocyanurate (Fichlor) | 30.0 |
| $C_9$–$C_{11}$ chain Fatty alcohol (unethoxylated) (Dobanol 91) | 7.0 |
| White mineral Oil (5 cps viscosity) | 1.0 |
| (Carnation Mineral Oil) | 100.0 |

What is claimed is:

1. An extruded lavatory cleansing block comprising:
   a) about 20 to 40% by weight of a halogen release bleaching agent;
   b) about 0.1 to 8.0% by weight of a polybutene compound to stabilize the bleaching agent, said polybutene compound having the formula:

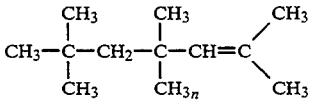

wherein n can be varied to give an average molecular weight of 320 to 2,300;
   c) about 50 to 65% by weight of an oxidation resistant surfactant; and
   d) about 2 to 10% of a solubility control agent.

2. The lavatory cleansing block of claim 1 wherein said bleaching agent is a chlorine release agent.

3. The lavatory cleansing block of claim 2 wherein said chlorine release agent is sodium dichloroisocyanurate.

4. The lavatory cleaning block or tablet of claim 1 wherein said surfactant is anionic.

5. The lavatory cleansing block of claim 1 wherein said surfactant is a $C_6$–$C_{18}$ alkylbenzene sulfonate.

6. The lavatory cleansing block of claim 5 wherein said surfactant is selected from the group consisting of the alkali earth and alkali metal salt of hexadecyl diphenyl ether disulfonic acid, dodecyl diphenyl ether disulfonic acid and decyl diphenyl ether disulfonic acid.

7. The lavatory cleansing block of claim 1 wherein said surfactant is a diphenyl ether disulfonate.

8. The lavatory cleansing block of claim 1 wherein said surfactant is selected from the group consisting of the alkaline earth and alkali metal salt of hexadecyl diphenyl ether sulfonic acid, dodecyl diphenyl ether disulfonic acid and decyl diphenyl ether disulfonic acid.

9. The lavatory cleansing block of claim 1 wherein said surfactant is an alkyl dimethylamine oxide having 12 to 25 carbon atoms.

10. The lavatory cleansing block of claim 1 wherein said surfactant is selected from the group consisting of N,N-dimethyl-1-tetra-decanamine oxide and N,N-dimethyl-1-octadecanamine oxide.

11. The lavatory cleansing block of claim 1 wherein said solubility control agent is a fatty alcohol.

12. The lavatory cleansing block of claim 1 including magnesium sulfate.

* * * * *